US008410941B2

(12) United States Patent
Kelly et al.

(10) Patent No.: US 8,410,941 B2
(45) Date of Patent: Apr. 2, 2013

(54) ANIMAL DETECTION SYSTEM AND METHOD

(75) Inventors: Sean Patrick Kelly, Loudonville, NY (US); Thomas Joseph Sundman, Littleton, NH (US)

(73) Assignee: LeviaThink Laboratories LLC, Loudonville, NY (US)

( * ) Notice: Subject to any disclaimer, the term of this patent is extended or adjusted under 35 U.S.C. 154(b) by 212 days.

(21) Appl. No.: 13/043,308

(22) Filed: Mar. 8, 2011

(65) Prior Publication Data

US 2011/0227733 A1 Sep. 22, 2011

Related U.S. Application Data

(60) Provisional application No. 61/311,626, filed on Mar. 8, 2010.

(51) Int. Cl.
*G08B 23/00* (2006.01)

(52) U.S. Cl. ..... 340/573.2; 340/691.1; 340/540; 340/541; 116/22 A

(58) Field of Classification Search ..... 340/573.2, 340/691.1, 540, 541, 552, 567, 573.1, 573.3, 340/693.1, 693.9, 435, 436, 468, 901, 903, 340/905; 116/22 A; 367/139
See application file for complete search history.

(56) References Cited

U.S. PATENT DOCUMENTS

| | | | | |
|---|---|---|---|---|
| 5,450,060 | A * | 9/1995 | Parkhurst | 340/539.26 |
| 5,461,231 | A * | 10/1995 | Sugimoto et al. | 250/342 |
| 5,554,972 | A | 9/1996 | Byrne | |
| 5,623,259 | A * | 4/1997 | Giangardella | 340/932.2 |
| 5,760,686 | A * | 6/1998 | Toman | 340/540 |
| 5,939,987 | A | 8/1999 | Cram | |
| 5,969,593 | A * | 10/1999 | Will | 340/384.2 |
| 6,016,100 | A | 1/2000 | Boyd et al. | |
| 7,098,775 | B2 | 8/2006 | Perlo et al. | |
| 7,113,098 | B1 | 9/2006 | Hayes | |
| 2002/0145519 | A1 | 10/2002 | Hykawy | |
| 2003/0071735 | A1 | 4/2003 | Hanson et al. | |
| 2009/0224913 | A1 | 9/2009 | Wu et al. | |
| 2010/0283608 | A1 | 11/2010 | Asplund et al. | |
| 2011/0012734 | A1 | 1/2011 | Reese et al. | |

OTHER PUBLICATIONS

Seth; Save the Animals and Yourself; Dec. 1, 2009; http://www.yankodesign.com/2009/12/01/save-the-animals-and-yourself; 5 pages.

Knapp et al.; Deer-Vehicle Crash Countermeasures Effectiveness Research Review; Proceedings of the 2003 Mid-Continent Transportation Research Symposium; pp. 1-10.

Huijser et al.; Overview of animal detection and animal warning systems in North America and Europe; Road Ecology Center, John Muir Institute of the Environment, Aug. 24, 2003; cover page and pp. 368-382.

Fischer; Detection Systems Reduce Collisions with Wildlife on Rural Highways; Jan. 1, 2007; 3 pages; http://www.photonics.com/ArticlePrint.aspx?AID=39644.

(Continued)

*Primary Examiner* — Anh V La
(74) *Attorney, Agent, or Firm* — Hodgson Russ LLP

(57) ABSTRACT

A system for detecting an animal proximate a roadway is disclosed. In one embodiment of the invention, there is at least one warning station, a plurality of sensor stations, and a processor. Each of the plurality of sensor stations may have a first sensor and a second sensor. The processor may be configured to detect an animal using information provided by the first sensor and the second sensor, and to cause transmission of a warning signal to the at least one warning station when the animal is detected.

20 Claims, 8 Drawing Sheets

OTHER PUBLICATIONS

Huijser et al.; The Comparison of Animal Detection Systems in a Test-Bed: A Quantitative Comparison of System Reliability and Experiences with Operation and Maintenance; Western Transport Institute, Apr. 23, 2009; 123 pages.

Gray; Advances in Wildlife Crossing Technologies; U.S. Department of Transportation Federal Highway Administration, Sep./Oct. 2009, vol. 73, No. 2; pp. 1-14; http://www.fhwa.dot.gov/publications/publicroads/09septoct/03.cfm.

* cited by examiner

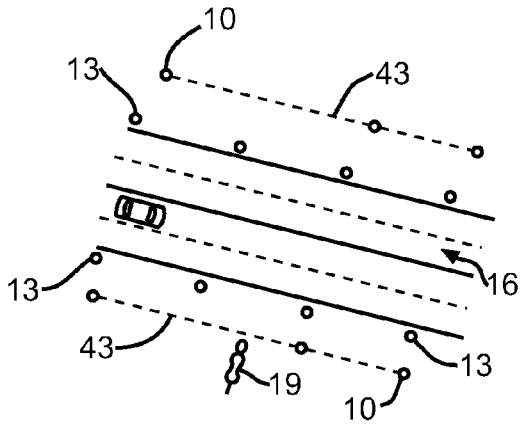

1. Large animal approaches the break-beam barrier as an oncoming car approaches.

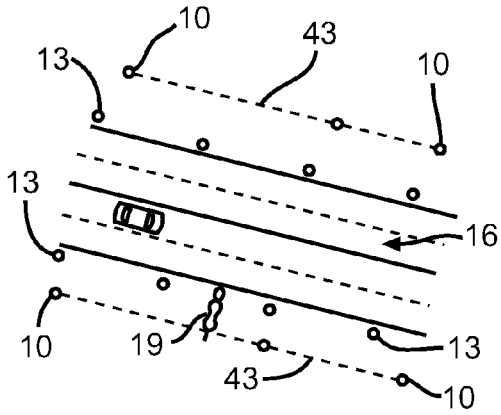

2. As the animal crosses the barrier, warning lights located on highway reflector poles are activated.

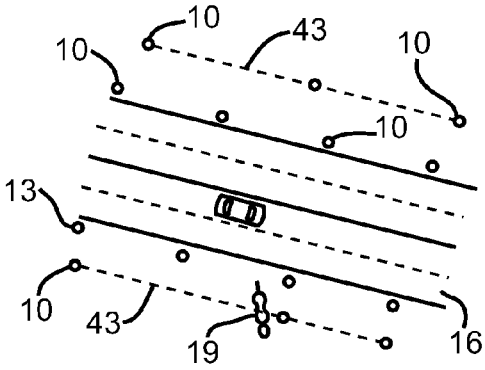

3. Warning lights alert driver of an animal crossing event and urges the vehicle to reduce speed.

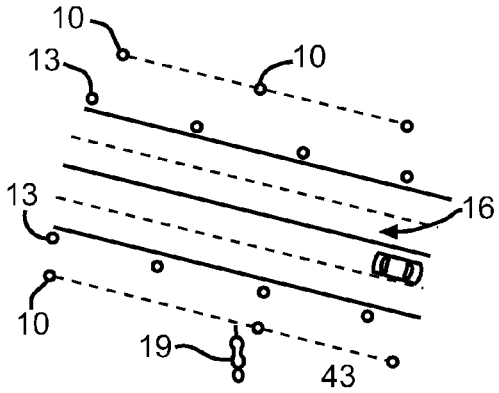

4. The sensor stations intelligently detect that the animal has turned around and exited the road. The warning lights are deactivated accordingly.

FIG. 3B

ANIMAL DETECTION SYSTEM AND METHOD

CROSS-REFERENCE TO RELATED APPLICATION

This application claims the benefit of priority to U.S. provisional patent application Ser. No. 61/311,626, filed on Mar. 8, 2010.

FIELD OF THE INVENTION

The present invention relates generally to animal detection systems, and more particularly to roadside animal detection systems.

BACKGROUND OF THE INVENTION

Existing animal detection systems ("ADSs") include sensor stations and warning stations. When an animal is detected by one of these sensor stations, the warning stations illuminate lights, which are intended to warn drivers of the presence of the detected animal.

There are only about 34 different locations in the world (12 in North America and 22 in Europe) where ADSs have been tested or permanently installed. Of those 34, only 8 are still in operation today. The majority of the ADSs that were removed had problems, which included (a) a high rate of false positives (providing a warning when an animal was not in the area), (b) a high rate of false negatives (providing no warning when an animal was in the area), (c) a wide variety of maintenance issues resulting from complex hardware that was difficult to fix and was not readily available, (d) an inability to accurately detect the direction in which an animal is moving, (e) large costs associated with the purchase and installation of ADSs, and (f) large bulky equipment that is not aesthetically pleasing. These problems have discouraged acceptance of ADSs installed along roadways.

SUMMARY OF THE INVENTION

The invention may be embodied as an animal detection system. Such a system may include at least one warning station and at least one sensor station arranged adjacent to a roadway. Each sensor station may include a first sensor attached to the sensor station at a first distance from the ground and at a first distance from the roadway, and a second sensor attached to the sensor station at a second distance from the ground and at a second distance from the roadway.

A processor may be in communication with the first sensor and the second sensor, and configured to determine the presence of an animal using information provided by the first sensor and the second sensor, and to cause transmission of a warning signal to the at least one warning station when the animal is detected.

Also, the invention may be embodied as a method of detecting an animal. In one such method, a plurality of sensor stations are arranged adjacent to a roadway. Each sensor station includes a first sensor attached to the sensor station at a first distance from the ground and at a first distance from the roadway, and a second sensor attached to the sensor station at a second distance from the ground and at a second distance from the roadway. Sensor information is transmitted from the plurality of sensor stations to a processor. Information provided by the plurality of sensor stations is analyzed by the processor to determine a condition of an animal.

BRIEF DESCRIPTION OF THE DRAWINGS

For a fuller understanding of the nature and objects of the invention, reference should be made to the accompanying drawings and the subsequent description. Briefly, the drawings are:

FIG. 3B shows four schematics and text describing how the system might operate to indicate the presence of an animal near a roadway.

DETAILED DESCRIPTION OF THE INVENTION

Figure 1A:
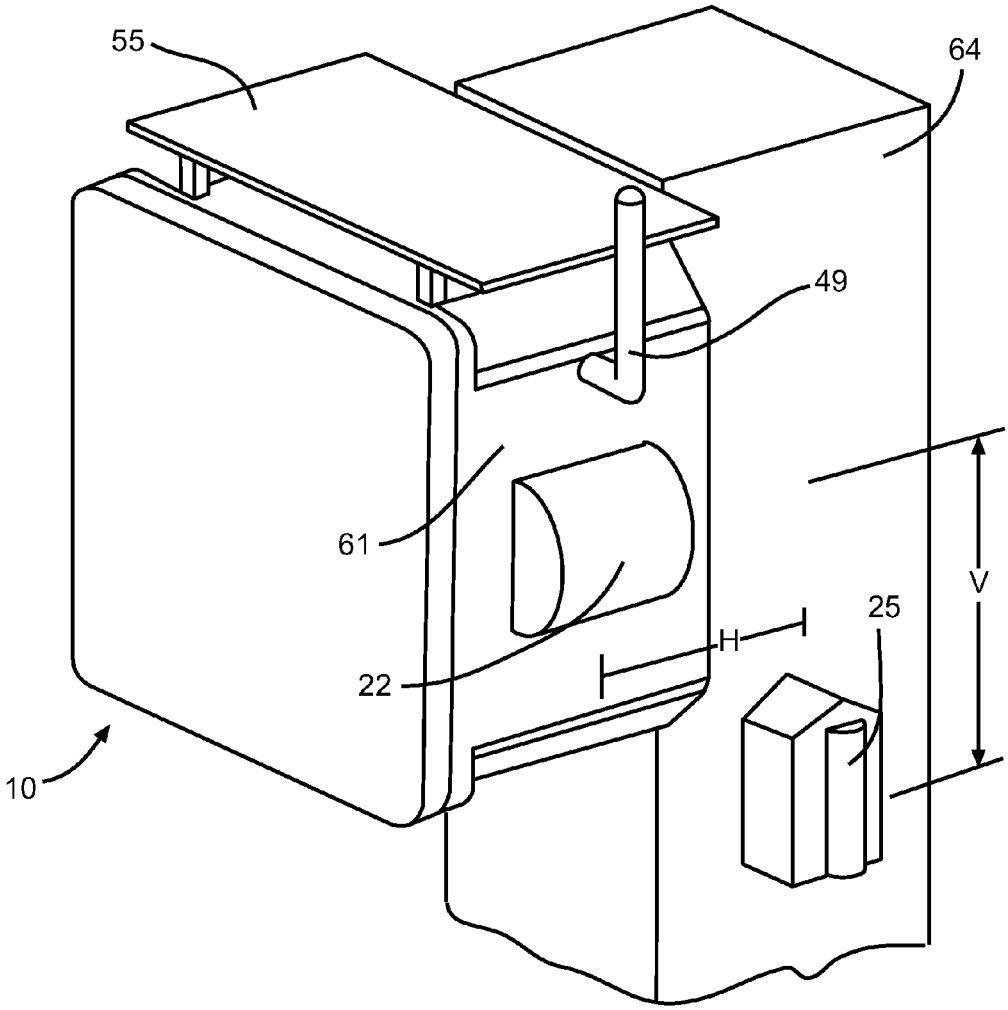
FIG. 1A is a perspective view of a sensor station according to the invention.
Figure 1B:
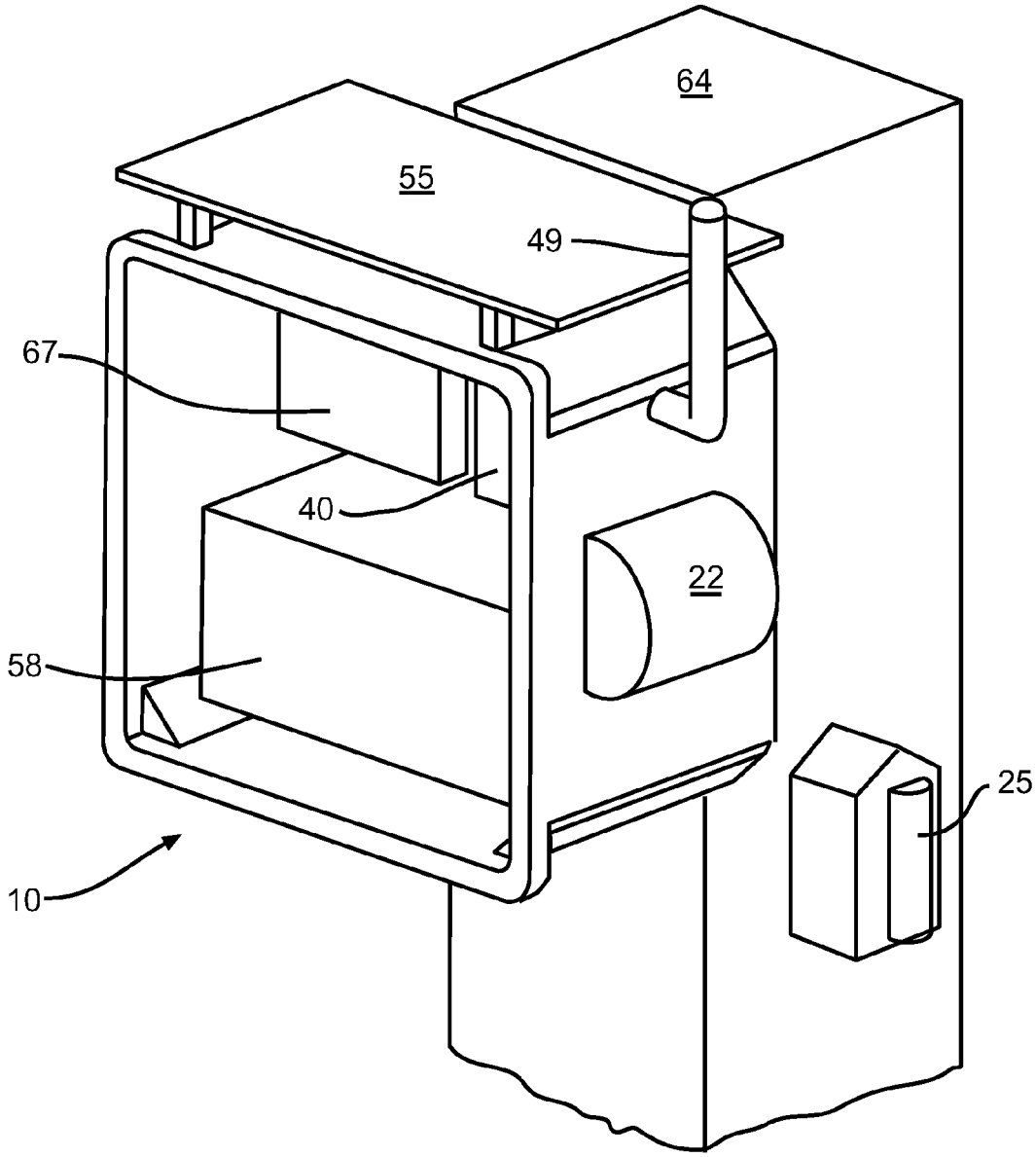
FIG. 1B is similar to FIG. 1A, but a panel has been removed to show components of the sensor station.
Figure 1C:
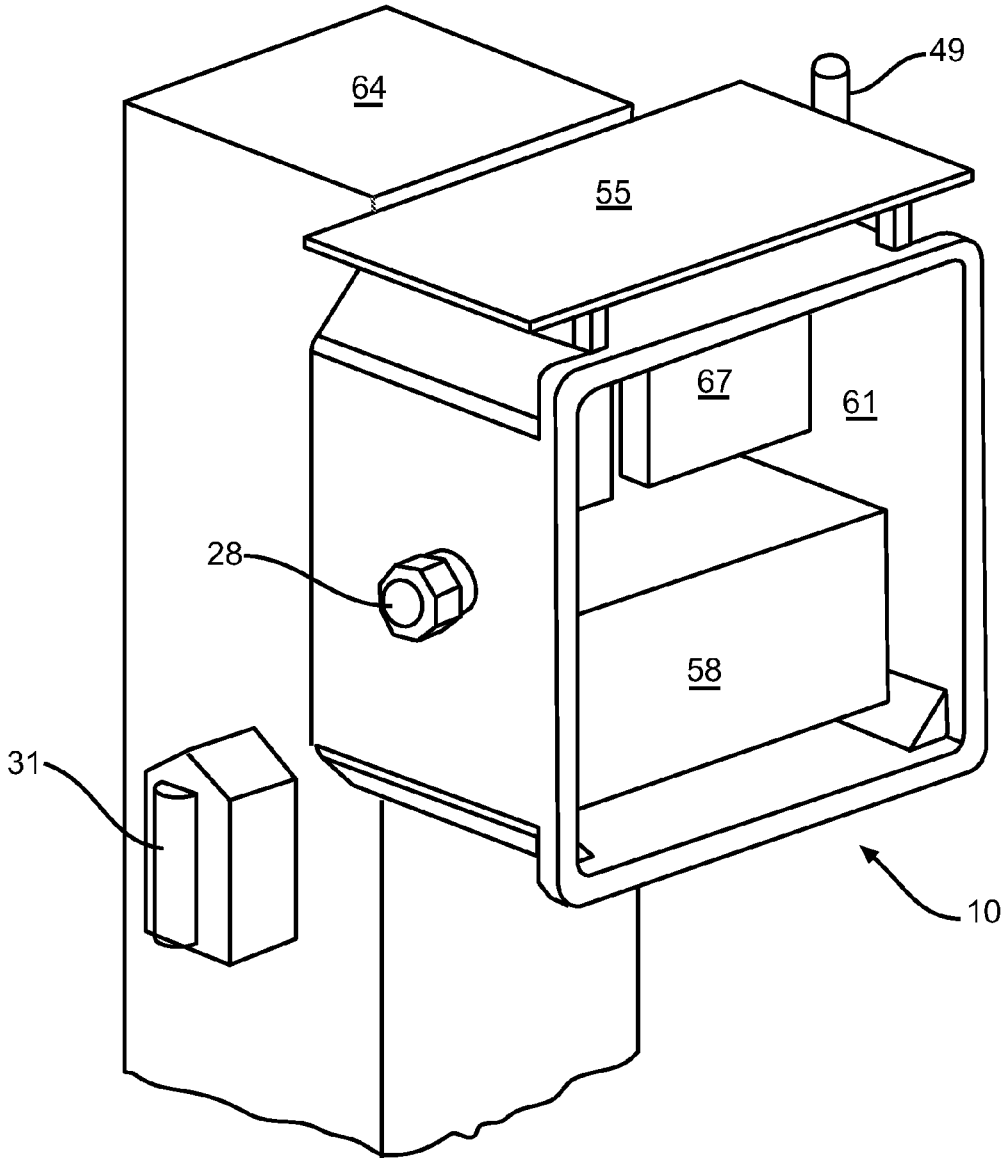
FIG. 1C is another perspective view of the sensor station shown in FIG. 1B.
Figure 2A:
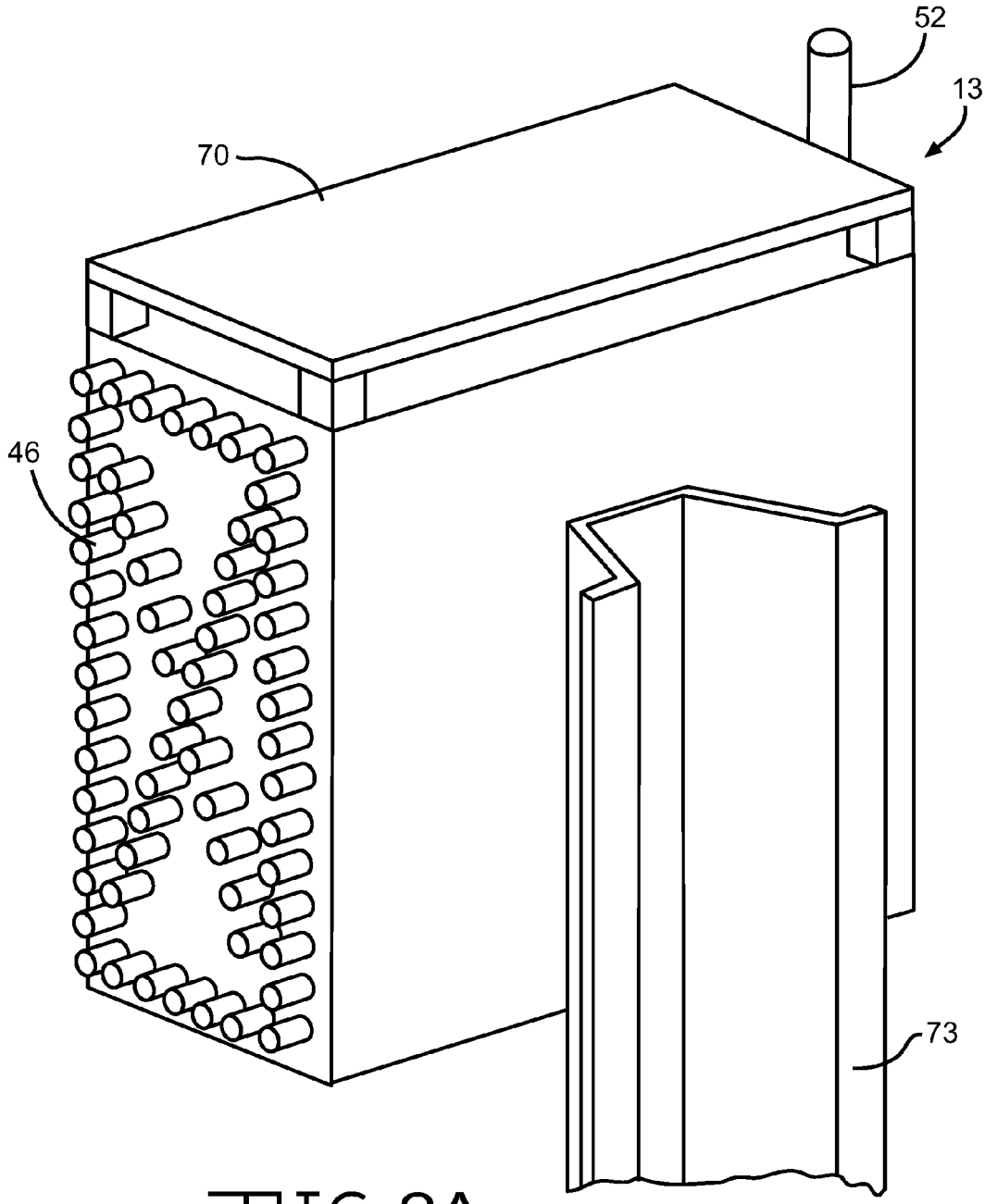
FIG. 2A is a perspective view of a warning station according to the invention.
Figure 2B:
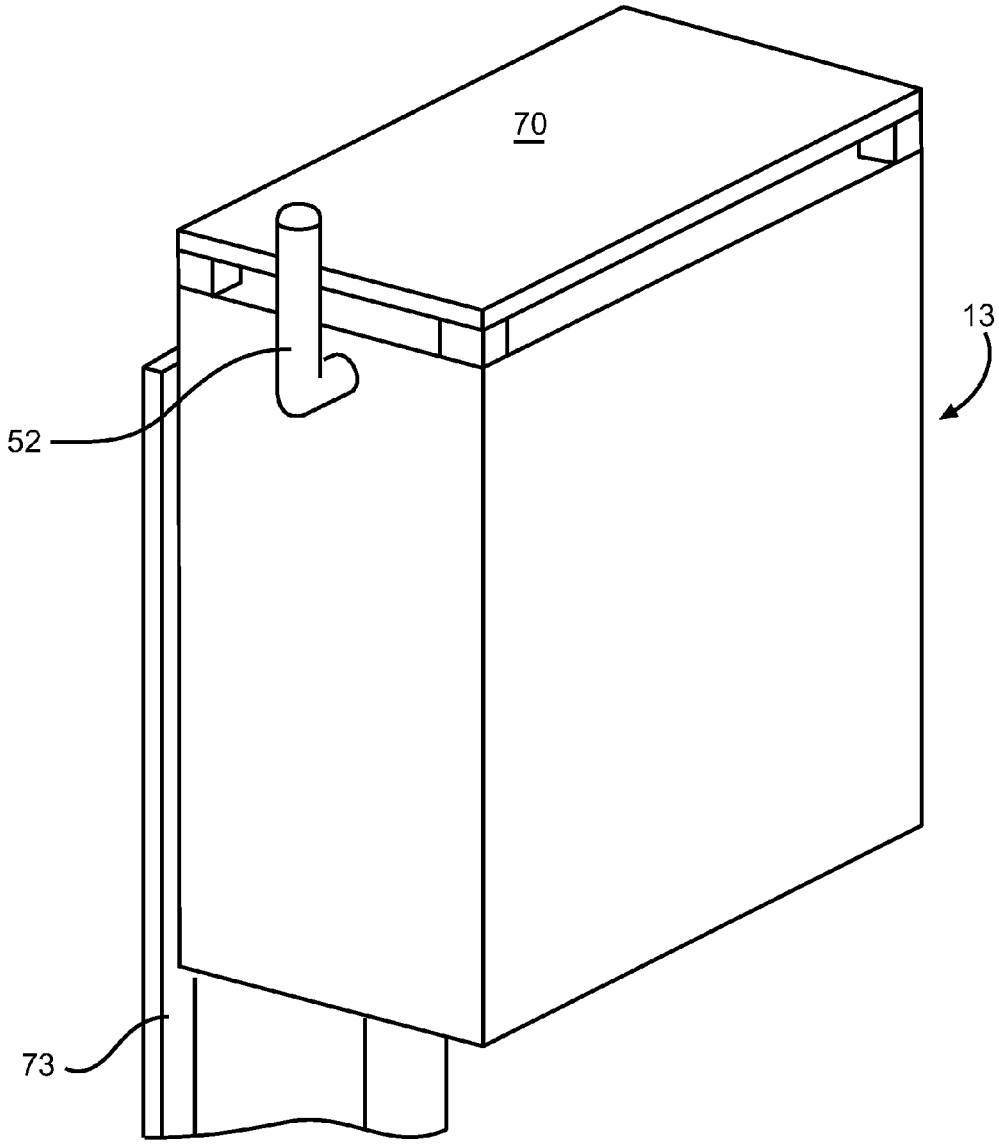
FIG. 2B is a different perspective view of the warning station of FIG. 2A.

The invention may be embodied as an ADS having two types of stations: (a) sensor stations 10, and (b) localized warning stations 13 that may be placed at line-of-sight intervals along a road 16. FIGS. 1A, 1B and 1C depict a sensor station 10 according to the invention, and FIGS. 2A and 2B depict a warning station 13 according to the invention. Each sensor station 10 may have at least two types of sensors. When an animal 19 is detected by a sensor station 10, a warning signal is sent from the sensor station 10 to one or more of the warning stations 13. Upon receiving such a warning signal, the warning station 13 provides an indication, which can be interpreted by drivers that an animal 19 has been detected.

Warning stations 13 may be spaced less than every quarter mile, and preferably are spaced every 250 feet, in order to provide drivers with sufficient advanced warning that an animal 19 has been detected in the area and to allow drivers more time to slow down. A small distance between warning stations 13 may reduce the rate of false negatives reported by drivers. A 250 foot spacing may coincide with the spacing of reflector poles found on many highways, and so it may be possible to mount the warning stations 13 on such reflector poles, thereby saving money during installation. By keeping the spacing of warning stations 13 small, the present invention may allow the location of an animal 19 to be more precisely identified to drivers, which in turn may allow for providing a more meaningful warning to drivers.

Figure 1D:
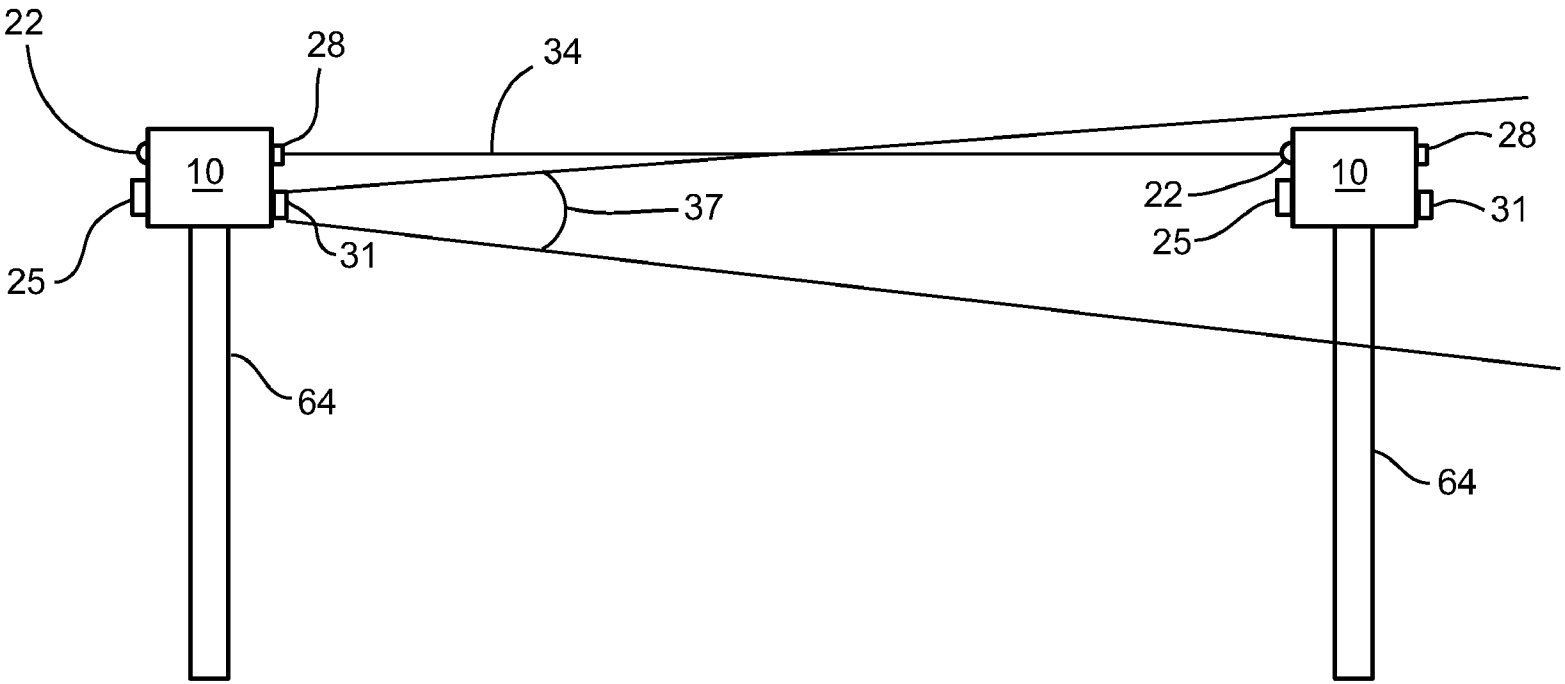
FIG. 1D is a schematic showing two sensor stations and the beams which extend between them.

The sensor stations 10 may include at least two types of sensors. The two types of sensors may rely on electromagnetic energy with different frequency ranges. For example, in one embodiment of the invention, each sensor station 10 includes a laser break-beam sensor 22 and also an infrared break-beam sensor 25. The emitters 28, 31 corresponding to the sensors 22, 25 may have different angles (i.e. varying areas) of coverage. For example, the first emitter/sensor 22, 28 combination may have a smaller area of coverage than the second emitter/sensor 25, 31 combination. FIG. 1D depicts the beams of two types of energy emitters 28, 31, one emitter 28 having an electromagnetic energy beam 34 that covers a narrow area, and the other having an electromagnetic beam 37 that covers a wide area. For example, the emitter 28 may be a laser and the emitter 31 may be an infrared emitter. By having sensors 22, 25 with different areas of detection, the first combination of emitter 28 and sensor 22 may be selected to detect an animal 19 over a narrower area, than the second combination of emitter 31 and sensor 25. This may be useful, for example, for avoiding false positives.

A programmed micro-processor/controller 40 (or logic circuit) may be in communication with the sensors 22, 25 and the micro-processor/controller 40 may be used to intelligently differentiate an actual crossing event from a false positive or false negative, such as those created by snow thrown from snow plows. The micro-processor/controller 40 may be programmed according to algorithms that use data from the sensor stations 10 regarding which of the sensor stations 10 detected an interruption in both the first sensor 22 and the second sensor 25, and the order in which those sensors were interrupted to identify an area where the animal 19 is located, and the direction in which the animal 19 is traveling. The micro-processor/controller 40 also may be programmed to use data from the sensor stations 10 to identify which of the warning stations 13 to activate or deactivate.

The two sensors 22, 25 on a sensor station 10 may be spaced apart from each other. In a similar manner, the emitters 28, 31 on an adjacent sensor station 10 may be similarly spaced apart from each other. By doing so, the micro-processor/controller 40 can determine the direction in which an animal 19 is moving by identifying the order in which the sensor beams 34, 37 are broken. Also, the speed of the animal 19 can be calculated using the time which lapses between detection of the animal 19 by one of the sensors 22 or 25 and detection of the animal 19 by the other sensor 22 or 25. The direction in which the animal 19 is moving can be used to determine if an animal 19 is moving toward or away from the roadway 16. If the micro-processor/controller 40 determines that the animal 19 is moving away from the roadway 16, the warning station 13 may be commanded by the micro-processor/controller 40 to deactivate.

The beams 34, 37 of the sensor stations 10 define a boundary 43. When one of the sensor stations 10 detects an animal crossing the boundary 43 and the direction in which the animal 19 is moving, the micro-processor/controller 40 may increment a counter in order to keep track of how many animals 19 are near the roadway 16. For example, when an animal 19 is detected crossing the sensor boundary 43 toward the roadway 16, the micro-processor/controller 40 may add to the counter, and when an animal 19 is detected crossing the sensor boundary 43 away from the roadway 16, the micro-processor/controller 40 may subtract from the counter. The counter information may be transmitted to other sensor stations 10, and in this manner, the ADS can accommodate a situation in which there are multiple animals 19 near the roadway 16. When the counter returns to zero, the micro-processor/controller 40 may send a signal commanding that the warning lights 46 of the warning stations 13 be turned off.

The micro-processor/controller 40 may keep track of the length of time that one or more of the sensor beams 34, 37 are broken. If a sensor beam 34, 37 is broken for an extended period of time, that sensor station 10 can be turned off, thereby shutting down part of the ADS, and eliminating the possibility that drivers would receive a warning indication when there is no animal 19. Such a condition might exist, for example, due to snow or brush residing in the sensor boundary 43. By shutting down only a portion of the ADS, other portions of the ADS may continue to provide warnings to drivers.

Each sensor station 10 may include a warning signal transmitter 49, which may emit an electromagnetic frequency signal (such as a radio signal) when an animal 19 has been detected. Each warning station 13 may include a warning signal receiver 52, which may detect when the warning signal transmitter 49 has emitted a warning signal. Upon detection of a warning signal sent by a sensor station 10, the warning station 13 may provide an indication, which can be interpreted by drivers as a warning that an animal 19 has been detected in the area. For example, the warning station 13 may include lights 46 which are illuminated to warn drivers that an animal 19 has been detected. The lights 46 may provide a message or illuminate a sign that provides a message urging drivers to slow down and/or be aware of the possible presence of an animal 19.

FIGS. 1A and 1B depict a sensor station 10 that is in keeping with the invention. The sensor station 10 includes a solar energy collection panel 55, which may be electrically connected to a rechargeable battery 58. The solar energy collection panel 55 and battery 58 can be used to provide electricity to enable the sensors 22, 25 to detect animals 19, and send warning signals to one or more warning stations 13. In this manner, electric power lines need not be installed, which provides for easy, quick and inexpensive installation of the sensor stations 10.

An enclosure 61 protects components from the weather, and may be mounted to a post 64. Transmitter 49 may extend from the enclosure 61, and thereby provide a better means to emit an electromagnetic warning signal when an animal 19 has been detected. An accelerometer (not shown) may be included and connected to the micro-processor/controller 40 so that if a sensor station 10 is knocked over (e.g. by a car, snow plow, etc.), that sensor station 10 may be taken off-line. The enclosure 61 may be formed to have suitable shapes and openings to accommodate the sensors 22, 25 and emitters 31, 34.

FIG. 1B shows additional detail of the sensor station 10 depicted in FIG. 1A. In FIG. 1B, a portion of the enclosure 61 has been removed in order to better illustrate that each sensor station 10 may include a micro-processor/controller circuit 40, battery 58, and charge controller 67. The charge controller 67 may govern when and how the battery 58 is charged. A very simple and low cost micro-processor/controller circuit 40, such as an ATmega 328, can be used. Such a micro-processor/controller 40 is inexpensive and consumes little power.

The sensors 22, 25 shown in the figures are at different heights above the ground, and differ in height by a distance "V." While the sensors 22, 25 are shown to be situated at different heights, they may be positioned at an equal distance from the ground. However, displacing the sensors 22, 25 at different heights, may help protect against false positives. For example, if the system is configured for the detection of larger animals 19, like a moose, placing the sensors 22, 25 at different heights may help protect against the sensors 22, 25 from being triggered by a bird flying horizontally past the sensor stations 10. While the sensors 22, 25 may be placed at any height above the ground, it may be advantageous to place the sensors 22, 25 greater than two feet above the ground—in this manner, small animals are less likely to be detected by the sensors 22, 25. The emitters 28, 31 may be similarly positioned at different heights above the ground.

Also, the sensors 22, 25 shown in the figures are not vertically aligned. Instead, the non-vertical alignment results in a horizontal distance (shown in FIG. 1A as "H") separating the sensors 22, 25. When the horizontal distance "H" is not equal to zero, the ADS obtains an ability to detect the direction in which an animal 19 is moving. For example, if an animal 19 crosses the sensor boundary 43 by tripping the laser sensor 22 prior to the infrared sensor 25, the system will be able to determine whether the animal 19 is moving toward or away from the roadway 16. In this manner, the warning signal may be sent when the animal 19 is detected moving toward the road 16, and then the warning signal may be stopped when the animal 19 is detected moving away from the road 16. Preferably, the horizontal distance "H" is greater than two inches. The emitters 28, 31 may be similarly positioned at different distances from the road 16.

FIGS. 2A and 2B depict a warning station 13 according to the invention. The warning station 13 may be equipped with a solar energy collection panel 70, which may be electrically connected to a rechargeable battery. The solar collection panel 52 and battery of the warning station 13 can be used to provide electricity to enable components of the warning station 13 to receive warning signals from one or more sensor stations 10, and provide a warning to drivers, for example, by illuminating the lights 46. In this manner, electric power lines need not be installed, which provides for easy, quick and inexpensive installation of the warning stations 13.

FIGS. 2A and 2B show that a warning station 13 may include a receiver 52. Receiver 52 may be used to receive a warning signal from a sensor station 10. The warning station 13 may include warning lights 46, for example, in the form of an array of light emitting diodes, which may be used to provide drivers on the roadway 16 with a warning that an animal 19 has been detected. The warning station 13 may be mounted to a post 73 that is located near the roadway 16.

Figure 3A:
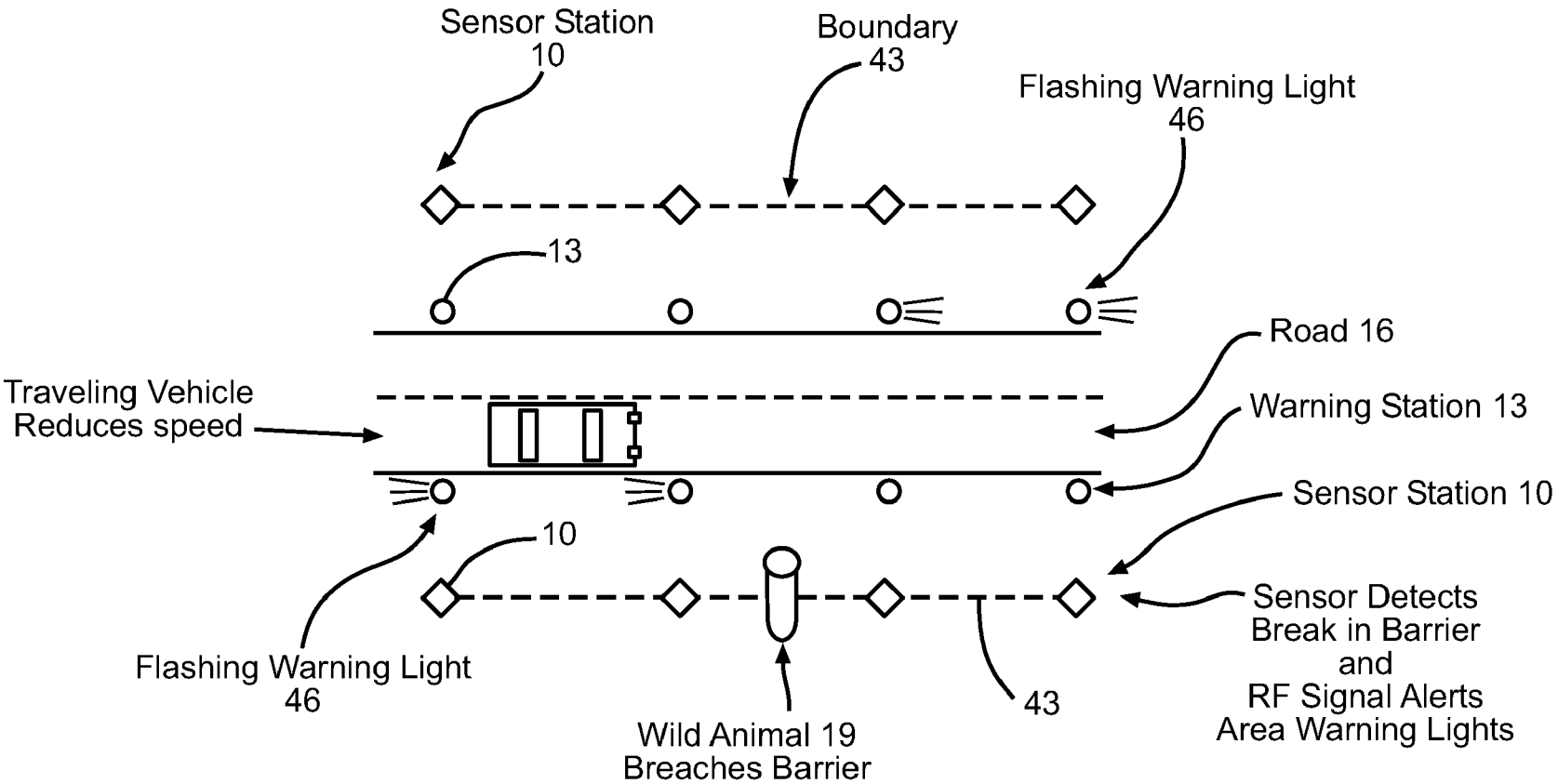
FIG. 3A is a schematic showing an ADS according to the invention used in conjunction with a roadway.

FIGS. 3A and 3B describe how the system of break-beam sensor stations 10 might communicate with the warning stations 13 to provide a driver with a warning. FIG. 3A depicts a wild animal 19 breaching the boundary 43. When the beams of the sensors 22, 25 are broken, the presence of the animal 19 at the boundary 43 is determined by the micro-processor/controller 40, and a warning signal is transmitted to one or more of the warning stations 13. Upon receipt of the warning signal, warning stations 13 may then illuminate warning lights 46 to provide drivers on the roadway 16 with a warning that an animal 19 has been detected. FIG. 3B depicts the process of an animal 19 approaching boundary 43 and crossing the boundary 43. Once the animal 19 has crossed boundary 43, warning lights 46 are activated. After the sensor stations 10 detect that the animal 19 has exited boundary 43, warning lights 46 are deactivated.

A sensor station 10 and a warning station 13 that are in keeping with the invention may be each made so as to use less power than an ordinary household flashlight. Since the ADS may need to operate only part of the day when animal 19 crossings are most likely, it is believed that a small (1'×1' 12V) solar panel 55, 70 and battery 14 (6"×3"×3") can power the system for three days without supplemental sunlight.

Each sensor station 10 of the present invention may be relatively independent of the others. For example, if one sensor station 10 fails, the entire ADS system need not be rendered inoperable. Furthermore, using a predetermined radio frequency band, each of the sensor stations 10 can communicate with at least two other nearby devices (sensor stations 10 and/or warning stations 13), which may be within 500 feet of each other. Consequently, the present invention may identify more accurately where along the roadway 16 the animals 19 are located. Such a localized ADS system may allow for advanced warning while also reducing the number of false positives reported.

Each sensor station 10 may be equipped to send information about its activities to a recording station (not shown), which may be programmed to store information for use in determining how the ADS is operating, and how animals 19 are moving through the area.

The components of the sensor stations 10 and warning stations 13 may be selected from those currently available from vendors which provide electrical components through mail-order or the Internet. For example, the laser emitter may be laser diode model no. CA-3-4-650A, which is available from Creative Technology Lasers of Walnut Creek, Calif. The infrared emitter may be a photo-electric sensor model no. 1151E-6517, which is available from Eaton Cutler-Hammer of Cleveland, Ohio. Such emitters are inexpensive and consume little power. In doing so, the cost of the system may be kept low, and maintenance may be quickly and easily performed.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. An animal detection system, comprising:

at least one warning station;

a plurality of sensor stations arranged adjacent to a roadway, each sensor station comprising a first sensor attached to the sensor station at a first distance from the ground and at a first distance from the roadway, and a second sensor attached to the sensor station at a second distance from the ground and at a second distance from the roadway, wherein the first distance from the ground and the second distance from the ground are not equal, and wherein the first distance from the roadway and the second distance from the roadway are not equal;

a processor in communication with the first sensor and the second sensor, and configured to detect an animal using information provided by the first sensor and the second sensor, and to cause transmission of a warning signal to the at least one warning station when the animal is detected.

2. The system of claim 1, further comprising a transmitter in communication with the processor, the transmitter being adapted to send the warning signal to the at least one warning station when the processor determines that the animal is proximate to the roadway.

3. The system of claim 2, wherein the warning signal is sent by the transmitter to more than one of the at least one warning stations.

4. The system of claim 2, wherein the processor is programmed to determine an approximate direction of the detected animal moving relative to the sensor stations by identifying an order in which the first sensor detects the animal and the second sensor detects the animal; and wherein the transmitter is adapted for sending the warning signal to the at least one warning station when the processor determines that a direction the animal is moving is toward the roadway.

5. The system of claim 2, wherein the at least one warning station includes a receiver adapted to receive the warning signal from the transmitter.

6. The system of claim 1, wherein the processor is programmed to determine the approximate direction of the detected animal moving relative to the sensor stations by identifying the order in which the first sensor detects the animal and the second sensor detects the animal.

7. The system of claim 1, wherein the first sensor is configured to have a wider angle of detection than the second sensor.

8. The system of claim 7, wherein the first sensor comprises an area beam and the second sensor comprises a line beam.

9. The system of claim 1, wherein the first sensor uses electromagnetic energy of a first frequency range and the second sensor uses electromagnetic energy from a second frequency range.

10. The system of claim 1, wherein the processor is programmed to transmit the warning signal only if both the first sensor and the second sensor detect the animal.

11. The system of claim 1, wherein the at least one warning station further comprises warning lights for providing a warning indication.

12. The system of claim 1, wherein a difference between the first distance from the ground and the second distance from the ground is greater than approximately three inches.

13. The system of claim 1, wherein a difference between the first distance from the roadway and the second distance from the roadway is greater than approximately two inches.

14. The system of claim 1, wherein the first distance from the ground and the second distance from the ground are greater than two feet.

15. The system of claim 1, wherein the processor is configured to determine an approximate speed of the detected animal by determining a time difference, the time difference being a difference between a time when the first sensor initially detects the animal and a time when the second sensor initially detects the animal.

16. A method of detecting an animal, comprising:

arranging a plurality of sensor stations adjacent a roadway, each sensor station comprising a first sensor attached to the sensor station at a first distance from the ground and at a first distance from the roadway, and a second sensor attached to the sensor station at a second distance from the ground and at a second distance from the roadway, wherein the first distance from the ground and the second distance from the ground are not equal, and wherein the first distance from the roadway and the second distance from the roadway are not equal;

transmitting sensor information from the plurality of sensor stations to a processor; and using the processor to analyze the information provided by the plurality of sensor stations to determine a condition of an animal.

17. The method of claim 16, further comprising determining an approximate direction of the detected animal moving relative to the sensor stations by identifying an order in which the first sensor detects the animal and the second sensor detects the animal.

18. The method of claim 17, further comprising sending a warning signal to at least one warning station when the processor determines that a direction the animal is moving is toward the roadway.

19. The method of claim 16, further comprising determining an approximate speed of the detected animal by determining a time difference, the time difference being a difference between a time when the first sensor initially detects the animal and a time when the second sensor initially detects the animal.

20. The method of claim 16, further comprising configuring the first sensor to have a wider area of detection than the second sensor.

* * * * *